US008935905B2

(12) United States Patent
Monzel

(10) Patent No.: US 8,935,905 B2
(45) Date of Patent: Jan. 20, 2015

(54) METHOD AND APPARATUS FOR THE MANUFACTURE OF DISPOSABLE, ONE-WAY, SINGLE-USE BEVERAGE CONTAINERS SUCH AS KEGS

(75) Inventor: Alois Monzel, Mörstadt (DE)

(73) Assignee: KHS GmbH, Dortmund (DE)

( * ) Notice: Subject to any disclaimer, the term of this patent is extended or adjusted under 35 U.S.C. 154(b) by 748 days.

(21) Appl. No.: 12/626,740

(22) Filed: Nov. 27, 2009

(65) Prior Publication Data

US 2010/0304944 A1 Dec. 2, 2010

Related U.S. Application Data

(63) Continuation-in-part of application No. PCT/EP2008/004209, filed on May 28, 2008.

(30) Foreign Application Priority Data

May 30, 2007 (DE) ..... 10 2007 025 286

(51) Int. Cl.
*B65B 3/04* (2006.01)

(52) U.S. Cl.
USPC ..... 53/471; 53/485; 53/133.2; 53/137.1; 53/268

(58) Field of Classification Search
USPC ..... 53/467, 485, 90, 133.2, 284.5, 53/470–471, 473, 484, 490, 133.1, 137.1, 53/266.1, 267–268
IPC ..... B65B 3/04
See application file for complete search history.

(56) References Cited

U.S. PATENT DOCUMENTS

| | | | | | |
|---|---|---|---|---|---|
| 3,529,399 | A | * | 9/1970 | Schieser et al. | 53/55 |
| 4,114,347 | A | * | 9/1978 | Morris et al. | 53/300 |
| 4,573,505 | A | * | 3/1986 | Lee et al. | 141/92 |
| 4,573,611 | A | * | 3/1986 | O'Connor | 222/147 |
| 4,678,101 | A | | 7/1987 | Nitchman et al. | |
| 4,690,299 | A | | 9/1987 | Cannon | |
| 4,834,266 | A | * | 5/1989 | Brewer et al. | 222/147 |
| 4,867,348 | A | * | 9/1989 | Dorfman | 222/173 |
| 5,137,162 | A | * | 8/1992 | Fritz | 215/40 |
| 5,244,117 | A | * | 9/1993 | Lombardo | 222/1 |
| 5,335,821 | A | * | 8/1994 | Osgar | 222/83 |
| 5,353,908 | A | * | 10/1994 | Wihlidal | 198/339.1 |
| 5,390,832 | A | | 2/1995 | Lombardo | |
| 5,415,329 | A | * | 5/1995 | Westlund | 222/397 |

(Continued)

FOREIGN PATENT DOCUMENTS

| | | |
|---|---|---|
| DE | 3927491 | 2/1991 |
| DE | 3927911 | 2/1991 |

(Continued)

OTHER PUBLICATIONS

International Search Report PCT/EP2008/004209.

(Continued)

*Primary Examiner* — Christopher Harmon
(74) *Attorney, Agent, or Firm* — Nils H. Ljungman & Associates

(57) ABSTRACT

A method of providing liquid-filled kegs and a manufacturing apparatus for performing the method of providing liquid-filled kegs, which method includes filling open plastic keg bodies with liquid, applying a disposable keg fitting, and releasing the neck of the filled, closed keg.

20 Claims, 8 Drawing Sheets

(56) References Cited

U.S. PATENT DOCUMENTS

| | | | | |
|---|---|---|---|---|
| 5,503,305 | A * | 4/1996 | Anderson | 222/180 |
| 5,671,585 | A * | 9/1997 | Peronek et al. | 53/253 |
| 5,689,932 | A * | 11/1997 | Peronek et al. | 53/201 |
| 6,283,177 | B1 * | 9/2001 | Naka et al. | 141/145 |
| 6,474,368 | B2 * | 11/2002 | Clusserath et al. | 141/6 |
| 6,666,358 | B1 * | 12/2003 | Field | 222/400.7 |
| 7,104,033 | B2 * | 9/2006 | Krulitsch | 53/467 |
| 7,278,452 | B2 * | 10/2007 | Taguchi et al. | 141/113 |
| 7,299,607 | B2 * | 11/2007 | Clusserath et al. | 53/503 |
| 7,380,683 | B1 * | 6/2008 | Oberhofer et al. | 220/366.1 |
| 7,533,788 | B2 * | 5/2009 | Harvey et al. | 222/509 |
| 7,877,967 | B2 * | 2/2011 | Monzel | 53/471 |
| 8,439,181 | B2 * | 5/2013 | Hausladen | 198/478.1 |
| 8,635,839 | B2 * | 1/2014 | Meinzinger | 53/426 |

FOREIGN PATENT DOCUMENTS

| | | | |
|---|---|---|---|
| DE | 4039434 | | 6/1992 |
| DE | 199 28 325 | A1 | 12/2000 |
| DE | 69821008 | | 11/2004 |
| DE | 10 2005 034178 | | 7/2006 |
| EP | 0561299 | | 9/1993 |
| EP | 0815009 | | 2/1999 |
| WO | WO 01/00502 | A | 1/2001 |
| WO | WO 03/014003 | A | 2/2003 |
| WO | WO 03/070579 | | 8/2003 |
| WO | WO 2007/019583 | | 2/2007 |
| WO | WO 2007/064277 | A1 | 6/2007 |
| WO | WO 2007/140884 | | 12/2007 |

OTHER PUBLICATIONS

German Search Report 10 2007 025 286.4-23.
Draught Master Auszug KHS Journal Mar. 2006.
Affidavit signed by Wolfgang Roidl, Aug. 9, 2011, and English translation thereof.
"Fingerzeig per Fühler, Neues rund ums Füllen und Verpacken auf der Brau Beviale 2006", in: Verpackungs-Rundschau, No. 12, 2006, p. 48.
Kunze, Wolfgang: "Technologie Brauer und Mälzer", 1998, VLB Berlin, Berlin, pp. 570-573.
Blüml, Susanne; Fischer, Sven: "Manual of Filling Technology, The theory and practice of filling liquid products", 2004, Behr's Verlag, Hamburg ISBN: 3899471970 pp. 382, 383, 513.
Kunze, Wolfgang: "Technologie Brauer und Mälzer", 1998, VLB Berlin, Berlin pp. 570-577.
Blüml, Susanne; Fischer, Sven: "Handbuch der Fülltechnik", 2004, Behr's Verlag, Hamburg ISN: 3-89947-089-3, pp. 514-523.
Handbuch 4, Verschließen mit Kronenkorken, Paris, DOC INE 96/024, 1996 Edition, pp. 1-7; 33-62.
Affidavit by Mr. Pöschl, and English translation thereof, Feb. 25, 2014.
Blüml, Susanne; Fischer, Sven: "Manual of Filling Technology, The theory and practice of filling liquid products", 2004, Behr's Verlag, Hamburg ISBN: 3899471970 p. 291, p. 333.

* cited by examiner

METHOD AND APPARATUS FOR THE MANUFACTURE OF DISPOSABLE, ONE-WAY, SINGLE-USE BEVERAGE CONTAINERS SUCH AS KEGS

CONTINUING APPLICATION DATA

This application is a Continuation-In-Part application of International Patent Application No. PCT/EP2008/004209, filed on May 28, 2008, which claims priority from Federal Republic of Germany Patent Application No. 10 2007 025 286.4, filed on May 30, 2007. International Patent Application No. PCT/EP2008/004209 was pending as of the filing date of this application. The United States was an elected state in International Patent Application No. PCT/EP2008/004209.

BACKGROUND

1. Technical Field

The present application relates to a method and apparatus for the manufacture of disposable, one-way, single-use beverage containers such as kegs.

2. Background Information

Background information is for informational purposes only and does not necessarily admit that subsequently mentioned information and publications are prior art.

Large-volume plastics material containers that are produced by means of blow molding preforms or premoldings made of plastics material or PET and are filled with the liquid product are known in the form of disposable containers for beverages, usually for mineral water or table water. These containers have a volume of 10-20 l, for example.

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

OBJECT OR OBJECTS

An object of at least one possible embodiment of the present application is to provide a method by means of which it can be possible to realize such containers in a simple manner.

SUMMARY

At least one possible embodiment of the present application teaches a method for forming packaging units with each having a container sealed with a keg fitting and filled with a liquid product. At least one possible embodiment of the present application teaches the following method steps: preparing the respective plastics material container, filling the container with the liquid product, supplying and inserting the respective fitting into a container opening, and producing a tight connection between the container and the fitting.

At least one possible embodiment of the present application teaches a device for forming packaging units with each having a container sealed with a keg fitting and filled with a liquid product. In at least one possible embodiment of the present application the device would have at least one fill position with a filling device, against which the respective container to be filled, being held at a container support by its container mouth, is pressable for the fill process through relative movement between the filling device and the container support, and wherein at least one tool is at a position downstream of the fill position for producing the connection between the respective container and the fitting after the filling process.

The method according to at least one possible embodiment of the present application is generally performed in a system in which the preparing of the containers, which are produced from plastics material, from PET (also identified as PET kegs), in one possible embodiment, is carried out by blow molding the containers, using plastics material premoldings, directly before they are put into use. There are then various variants with respect to the sequence of the individual steps for the method according to at least one possible embodiment of the present application, that is to say, among others:

Variant 1

In at least one possible embodiment of the present application, blow mold the containers, supply the prepared containers to a filling machine, fill the containers with the liquid product and then prepare and place the fittings onto the containers in the filling machine and connect the fittings and the containers in the filling machine.

Variant 2

In at least one possible embodiment of the present application, blow mold the containers, supply the prepared containers to a filling machine, fill the containers with the liquid product, prepare and place the fittings onto the containers in the filling machine and then connect the fittings and the containers in a separate station or machine that is downstream of the filling machine.

Variant 3

In at least one possible embodiment of the present application, blow mold the containers, supply the prepared containers to a filling machine, fill the containers with the liquid product, and then prepare and place the fittings onto the containers and connect the fittings and the containers in a separate station or machine that is downstream of the filling machine.

The fittings are, in at least one possible embodiment, realized as disposable fittings, comprising a fitting body of plastics material that is to be connected to the respective container by means of screw-connecting, pressing or locking and a fitting valve insert that is produced, for example, of stainless steel, the fittings, in at least one possible embodiment, being realized such that they engage over the container or over a container neck at that position in the manner of a cap only on the outside surface, in at least one possible embodiment, and the locking to the container is only effected on its outside surface, in at least one possible embodiment.

Irrespective of the respective development of the method according to at least one possible embodiment of the present application and of the chronology of the individual method steps, the filling of the containers with the liquid product always or virtually always occurs before the placing of the fittings onto the containers and the connecting of the fittings to the containers.

The advantage of the method of operation according to at least one possible embodiment of the present application, where the filling of the containers with the liquid product is carried out first of all, and only then, in at least one possible embodiment, the placing of the fittings onto the containers and the connecting of the fittings to the containers is effected, i.e. the sealing of the filled containers by means of the fittings, is, among others, that the fittings only, in at least one possible embodiment, have to be designed for discharging the liquid product, making it possible for said fittings to be simple in design, in at least one possible embodiment, making it possible for the containers to be filled using the entire cross-section of the container mouth, high-capacity filling thereby being possible (number of filled containers per unit time). In at least one possible embodiment of the present application, when the fittings are being mounted or pressed into position, the containers are preferably or in at least one possible embodiment held in a suspended manner, for example at a container neck or at a flange located at that position, the mounting or pressing of the fittings thereby being made possible, at least however considerably simplified, even if the containers have thin walls.

Further developments, advantages and application possibilities of the present application are produced from the following description of exemplary embodiments and from the Figures. In this case, all described and/or graphically represented features, in principle, individually or in arbitrary combination, are objects of at least one possible embodiment of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment of the present application is described below by way of the Figures of exemplary embodiments, in which, in detail.

DESCRIPTION OF EMBODIMENT OR EMBODIMENTS

Figure 1:
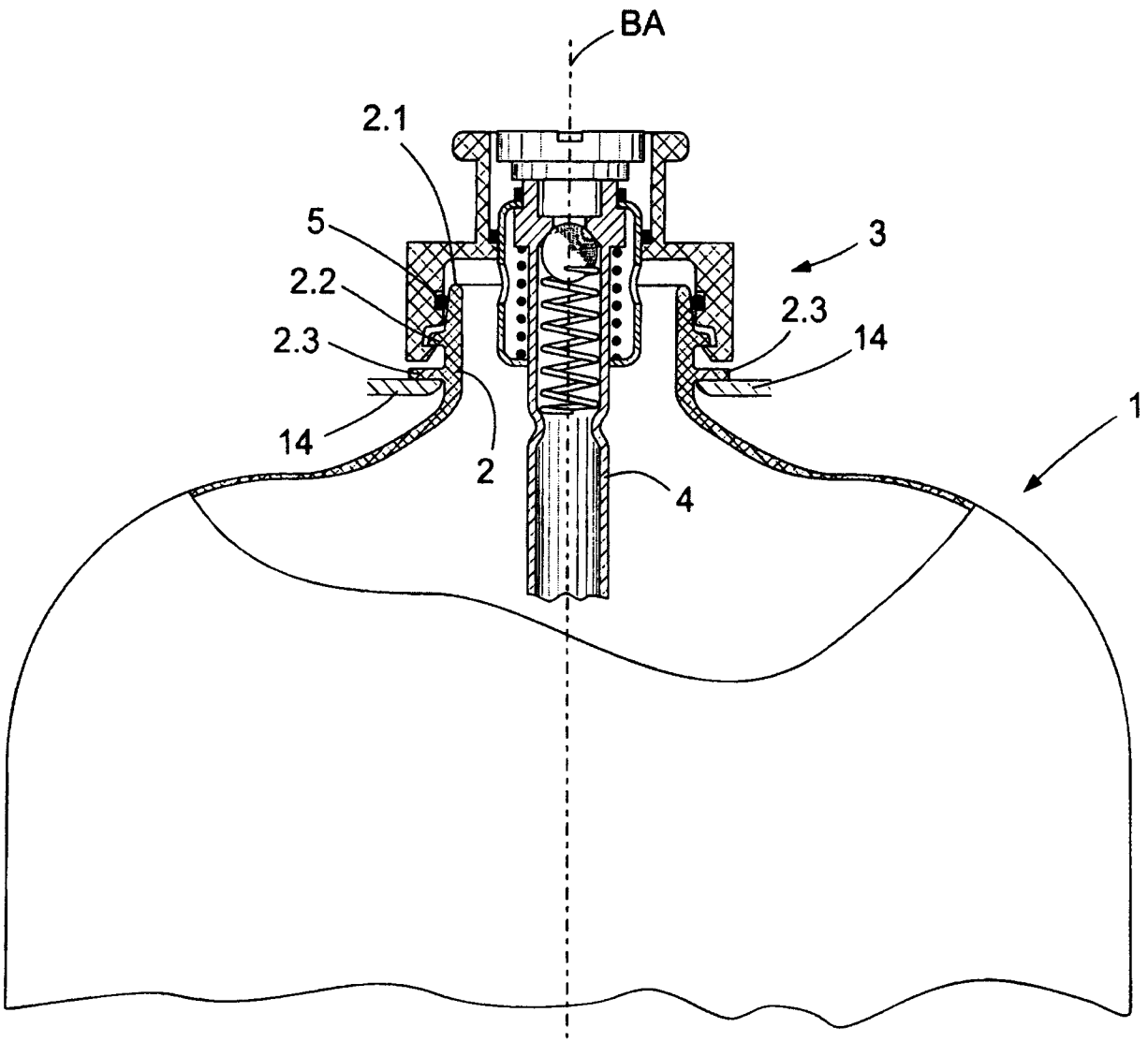
FIG. 1 is a partial representation in part section of a container (PET keg) in the region of the keg mouth, together with a disposable fitting provided on the keg mouth.

A large-volume container, which is produced by means of blow molding a plastics material, for example PET, is given the reference 1 in the Figures, forming, for example, a disposable container with a volume of 10 to 20 l. The container 1, which is filled with a liquid product, for example mineral water, table water, beer or a similar beverage, is closed in a sealing manner in the region of its container mouth 2.1 by means of a disposable fitting 3, said container mouth being shown in the upper part in FIG. 1 and being formed at a container neck 2.

Figure 2:
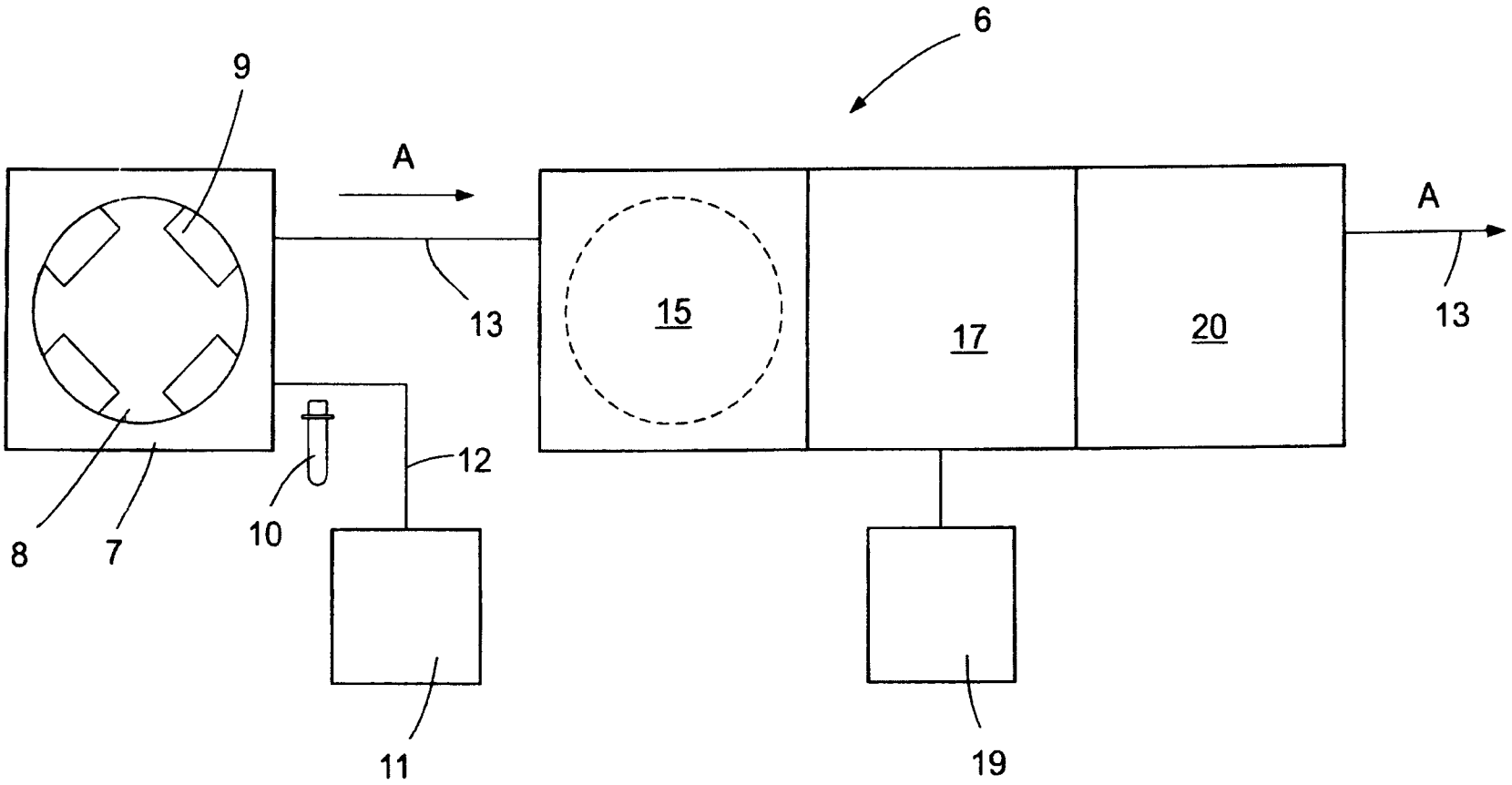
FIG. 2 is a schematic block diagram of a system for molding, filling and subsequent sealing of the PET keg in each case with a keg fitting.

FIG. 2, in a very simplified representation and in the form of a block or functional diagram, shows a system 6 for producing the containers 1, for mounting in each case one fitting 3 on each container 1 and for the subsequent filling of each container 1 with the liquid product by means of the fitting 3 or the valve insert 4 at that location.

In FIG. 2 the reference 7 indicates a blow molding machine, which, on a rotor 8 that is driveable in a rotating manner about a vertical machine axis, has a plurality of blow molds 9 on which the individual containers 1 are each formed from premoldings by means of stretch blow molding. The premoldings 10 in a thermoplastic plastics material, that is to say PET, are each supplied in an individual manner, and, in at least one possible embodiment, preheated, to the blow molding machine 7 or the blow molds 9 there by means of a conveying screw or conveying rail 11. The containers 1, produced by means of blow molding, are passed from the blow molding machine 7 to a conveying element 13, on which the containers 1 are held in a suspended manner 1, oriented with their container axis BA in the vertical direction and with their container mouth 2.1 at the top, on a flange or neck ring 2.3 that is realized below the flange 2.2. also on the container neck 2 and protrudes radially outwards beyond the container neck 2, as is indicated in FIG. 1 by the two-part container support 14.

Figure 3:
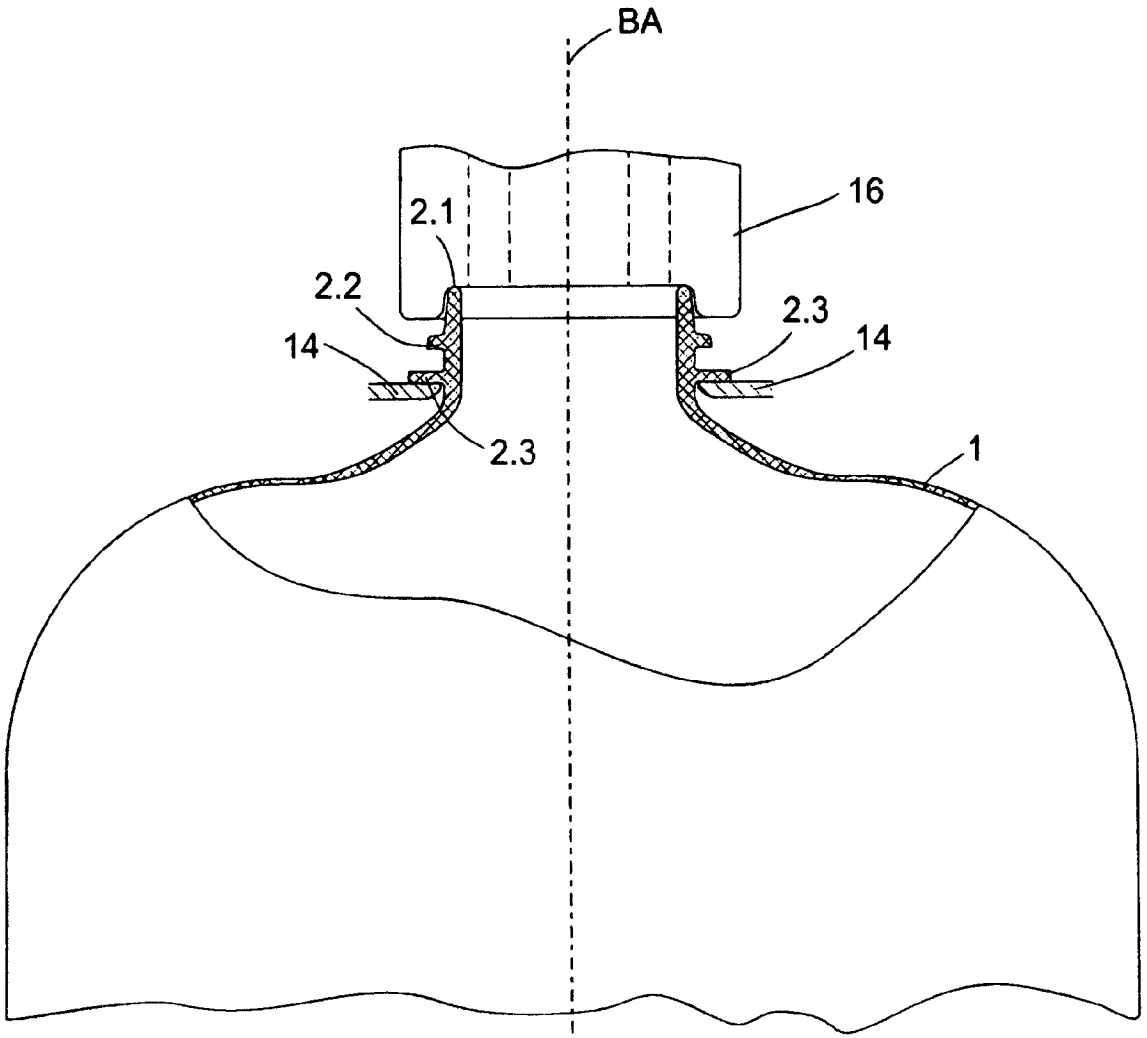
FIGS. 3-6 show a container in a representation similar to FIG. 1, in various stages of the processing.
Figure 4:
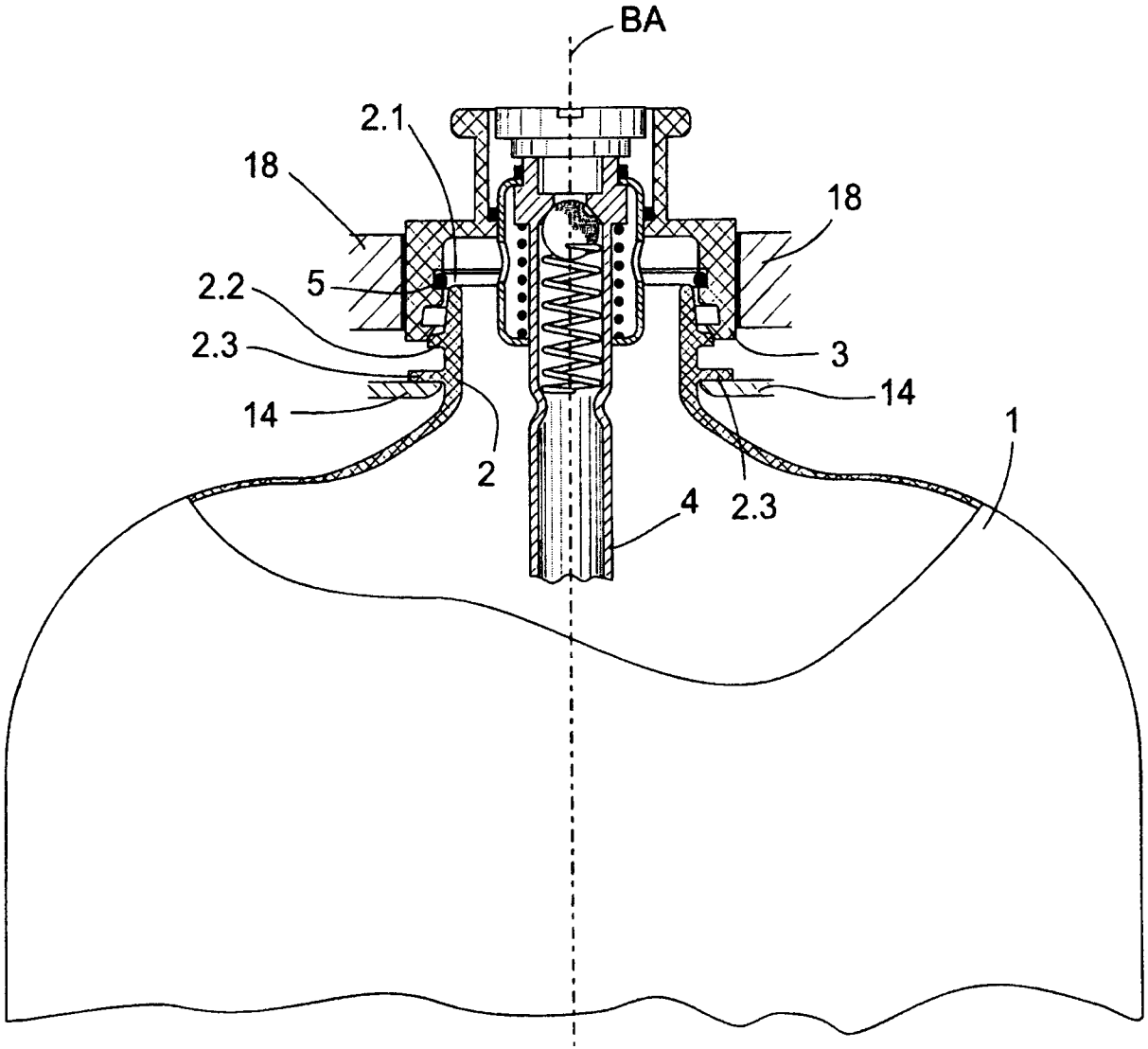

By means of suitable conveying means, for example by using conveying air, the containers 1 are conveyed (arrow A) to a station 15, which is in the form of a filling machine and in which the containers 1, still held in a suspended manner by their container flange 2.3 at a container support 14, are filled with the liquid product. The filling process is effected, for example, under counter pressure in such a manner that, in this case, the containers 1 rest with their container mouth 2.1 pressed against a filling device 16, as is shown in a schematic manner in FIG. 3. The filling machine forming the station 15 is, for example, a linear filling machine or a filling machine of the rotary type, with a plurality of filling positions, each having a filling device 16 and also an associated container support 14 at the periphery of a rotor that is driven in a rotating manner about a vertical machine axis.

Each filled container 1, still held in a suspended manner at a container support 14 by its flange 2.3, is then supplied to a station 17, in which a fitting 3 with a centering or transferring element 18 is placed onto the container mouth 2.1 of each container 1. The fittings, in this case, are supplied to the station 17 by a supplying unit 19 via a conveying section.

Figure 5:
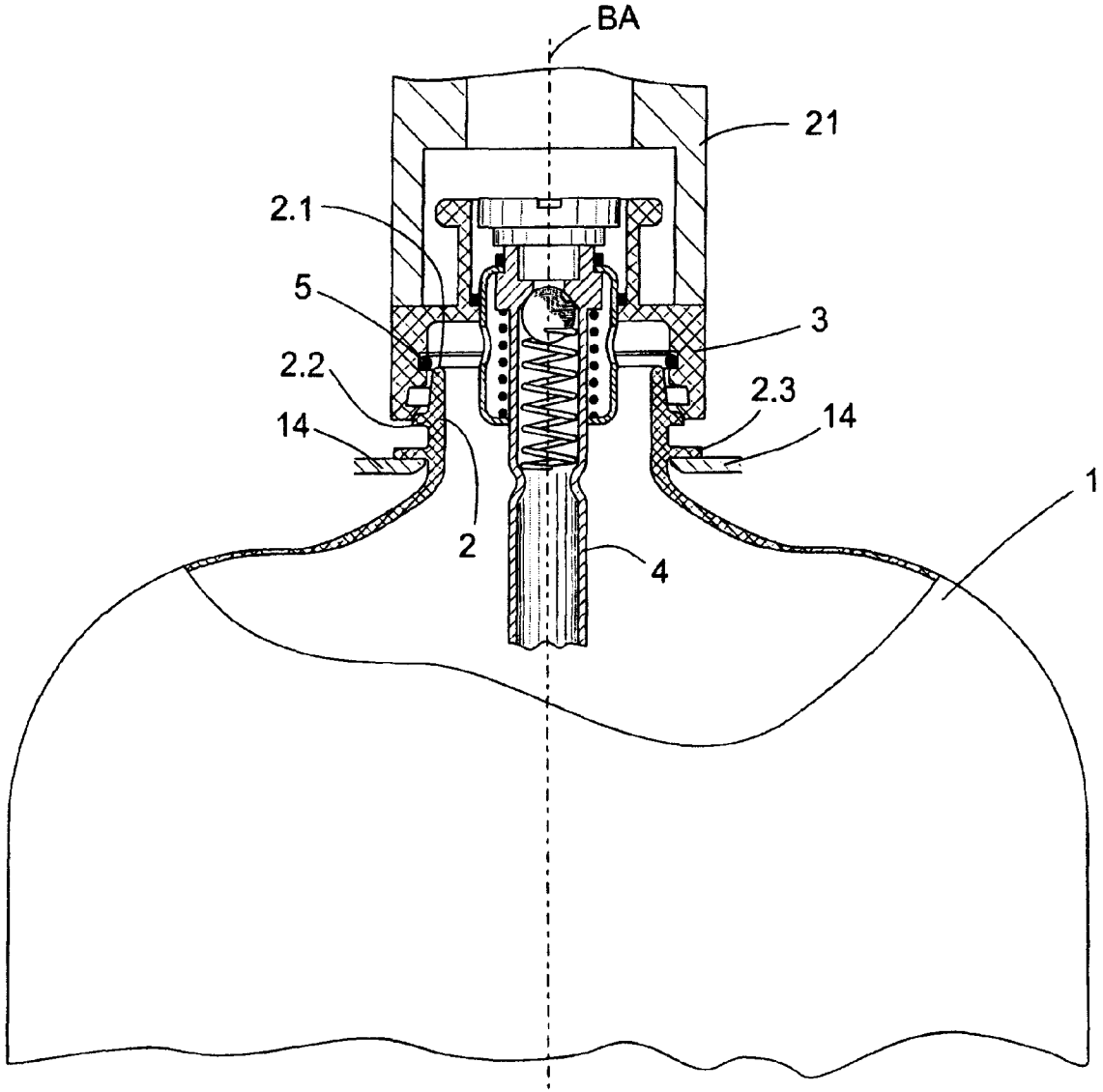
Figure 6:
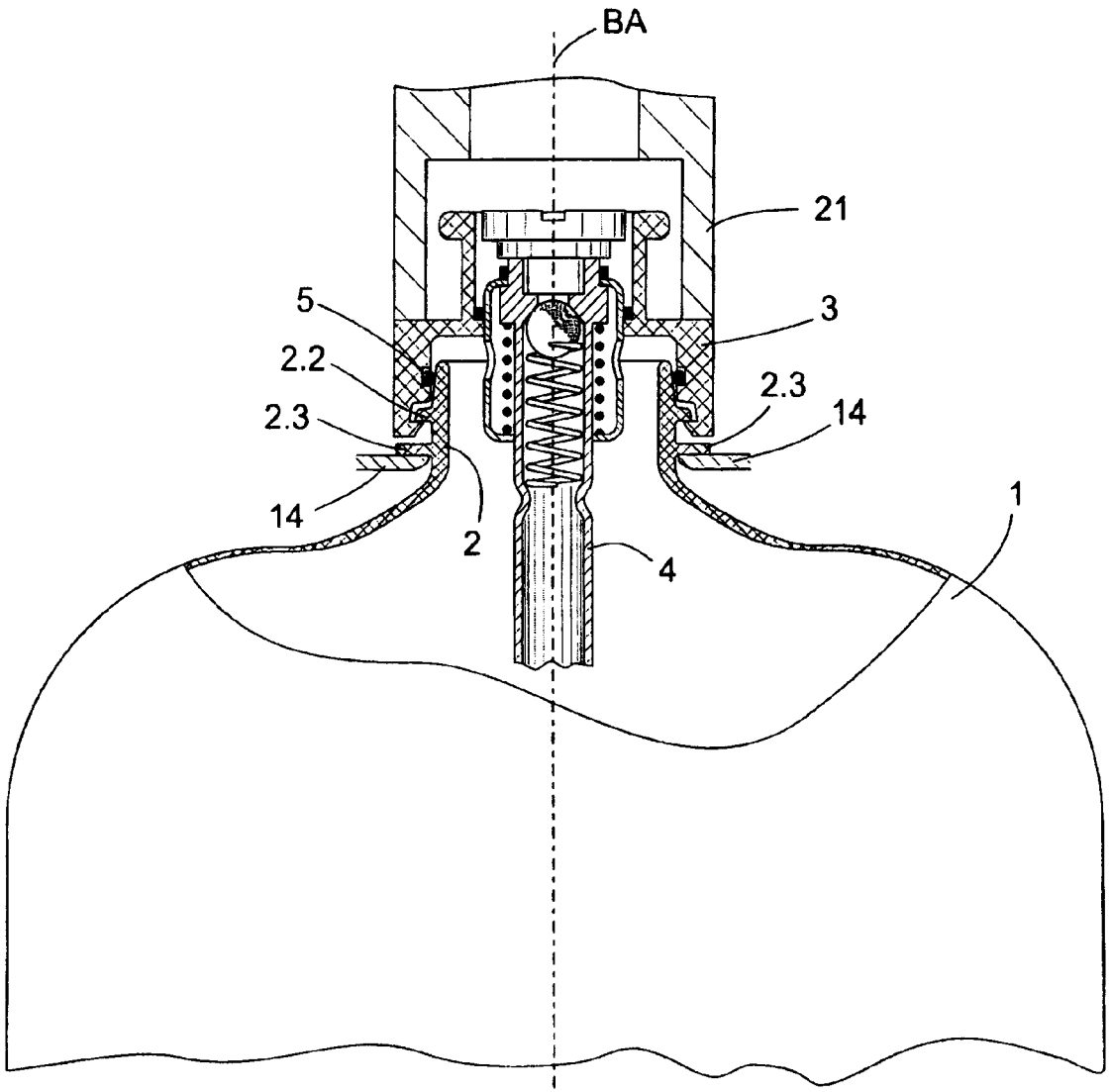

Each container 1, filled in this manner and then provided with a fitting, then passes, still suspended by its flange 2.3 at a container support 14, to a station 20, in which, corresponding to FIGS. 5 and 6, the respective fitting 3, preassembled with the sealing ring 5, is permanently or substantially permanently secured in a sealing manner to the container mouth 2.1 by means of pressing. The pressing is effected by using a ring-shaped closing and pressing tool 21, which, for example, is displaceable in the direction of the container axis BA and by means of which, when lowered, the respective fitting 3 is pressed just so far onto the container opening 2.1 that it finally engages behind the flange 2.2 on the outside of the container neck 2 in a positive locking manner, i.e. is held at the container neck 2 by means of locking and the sealing ring 5 seals off the gap between the container neck 2 and the fitting 3. The sealing and pressing tool 21 is, in at least one possible embodiment of the present application, realized simultaneously as the centering tool in order to secure the respective fitting 3 in a centered manner, with respect to the container axis BA on the container opening 2.1 by means of pressing.

The stations 17 and 20 are, for example, part of the filling machine that forms the station 15, in at least one possible embodiment, however they are part of a machine downstream of the filling machine. In addition, it is also possible for the station 17 still to be part of the filling machine but to be formed by a machine downstream of the filling machine.

The filled containers 1 are supplied in the conveying direction by means of a conveyor 22 to another use and/or process, for example to a labeling machine.

Figure 7:
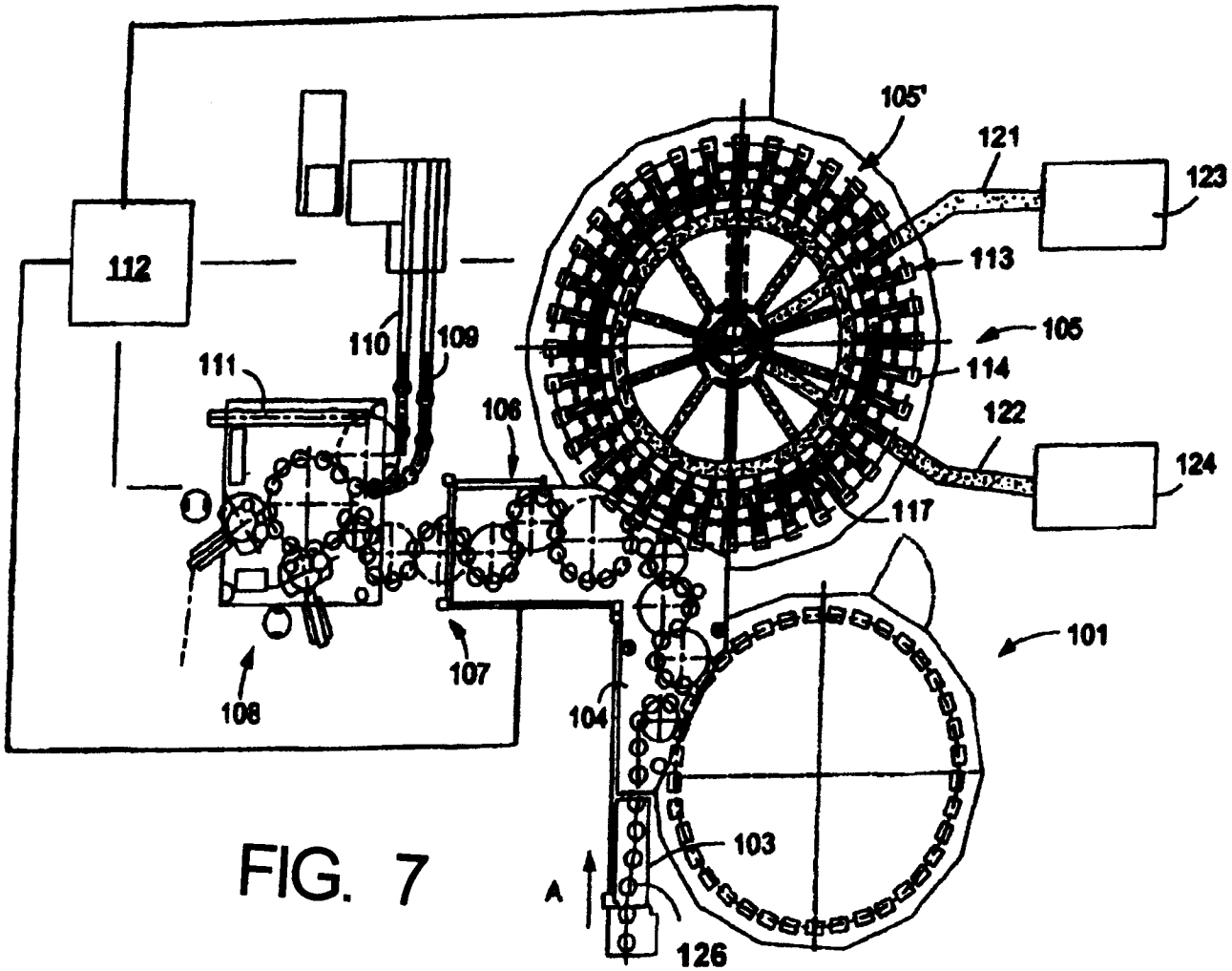
FIG. 7 shows schematically the main components of one possible embodiment example of a system for filling containers.

FIG. 7 shows schematically the main components of one possible embodiment example of a system for filling containers, possibly, a beverage bottling plant for filling bottles 2 with at least one liquid beverage, in accordance with at least one possible embodiment, in which system or plant could possibly be utilized at least one aspect, or several aspects, of the embodiments disclosed herein.

Figure 1A:
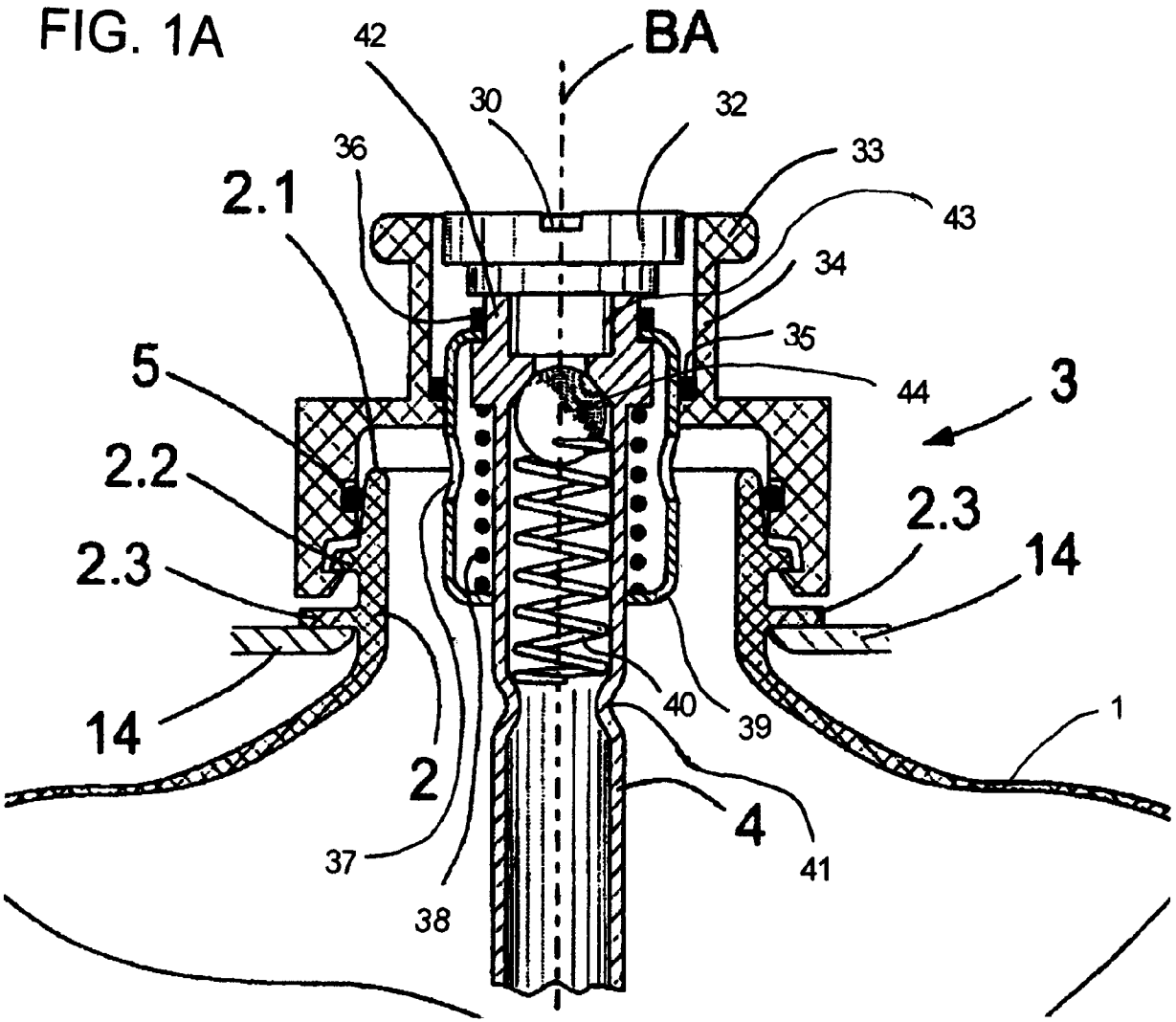
FIG. 1A is an expanded view of the partial representation in part section of a container (PET keg) in the region of the keg mouth of FIG. 1 showing details of the disposable fitting provided on the keg mouth.

FIG. 1A shows details of the disposable fitting 3 provided on the container mouth 2.1. Cap 32 is configured to screw into an upper dispensing portion 42 of valve insert 4 and keep upper dispensing portion 42 free of dirt and debris that may contact sealed container 1 after sealing with fitting 3. Cap 32 has slot 30 configured to cooperate with a screw driver and threads 43 on an outer annular surface configured to cooperate with threads in upper dispensing portion 42. Fitting 3 comprises cylindrical portion 34 extending upward and surrounding cap 32. Adjacent an upper most end of cylindrical portion 34 is flange 33 extending outward there around. Flange 33 is configured to protect cap 32 from physical impact. Sealing ring 36 surrounds upper dispensing portion 42 and is adjacent sleeve 39 and is configured to form a seal between upper dispensing portion 42 and sleeve 39. Sleeve 39 has apertures 37 and is provided with a downward force with spring 38. Sealing ring 35 is adjacent an inner surface of upwardly extending cylindrical portion 34 of fitting 3 and sleeve 39 and is configured to seal fitting 3 with sleeve 39. Fitting 3 has a ball valve comprising ball 44 and spring 40. Spring 40 is supported on a lower end with indentation 41 in valve insert 4 and is disposed to push ball 40 into a valve seat in upper dispensing portion 42.

FIG. 7 shows a rinsing arrangement or rinsing station 101, to which the containers, namely bottles 126, are fed in the direction of travel as indicated by the arrow A, by a first conveyer arrangement 103, which can be a linear conveyor or a combination of a linear conveyor and a starwheel. Downstream of the rinsing arrangement or rinsing station 101, in the direction of travel as indicated by the arrow A, the rinsed bottles 126 are transported to a beverage filling machine 105 by a second conveyer arrangement 104 that is formed, for example, by one or more starwheels that introduce bottles 126 into the beverage filling machine 105.

The beverage filling machine 105 shown is of a revolving or rotary design, with a rotor 105', which revolves around a central, vertical machine axis. The rotor 105' is designed to receive and hold the bottles 126 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 126 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 7, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles 126, there can be a beverage bottle closing arrangement or closing station 106 which closes or caps the bottles 126. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 126. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 126 to different locations.

The first output conveyer arrangement 109, in the embodiment shown, is designed to convey bottles 126 that are filled with a first type of liquid beverage supplied by, for example, the supply reservoir 123. The second output conveyer arrangement 110, in the embodiment shown, is designed to convey bottles 126 that are filled with a second type of liquid beverage supplied by, for example, the supply reservoir 124. The third output conveyer arrangement 111, in the embodiment shown, is designed to convey incorrectly labeled bottles 126. To further explain, the labeling arrangement 108 can comprise at least one beverage bottle inspection or monitoring device that inspects or monitors the location of labels on the bottles 126 to determine if the labels have been correctly placed or aligned on the bottles 126. The third output conveyer arrangement 111 removes any bottles 126 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In at least one possible embodiment of the present application, if the placing of the fittings 3 onto the filled container 1 and the subsequent pressing of the fittings 3 is carried out in an independent machine or device downstream of the filling machine, this latter is realized, in its turn, for example, as a machine of the rotary type, with a rotor that is driveable about a vertical machine axis and with a plurality of operating or pressing positions each with a pressing tool on said rotor.

The following are common to all or virtually all described specific embodiments:

the containers 1 are produced by means of blow molding directly before they are used, that is directly before they are filled with the liquid product, the containers 1, once they have been produced, are held constantly or virtually constantly in a suspended manner by their flange 2.3 during the entire process (filling the containers 1, placing the fittings 3 and mounting or fixing the fittings 3), the containers therefore have a predetermined orientation, the containers are filled first of all, in at least one possible embodiment, before the fittings 3 are placed in position and connected to the containers 1, and the connecting of the fittings 3 to the containers 1 is effected in each case by placing the fittings onto the container mouths 2.1 and by subsequent pressing.

Both during the filling process and in at least one possible embodiment during the mounting or pressing of the fittings 3, the containers 1 are supported at the container neck 2 or at the flange 2.3 in that location, that is to say, even after the blow molding of the containers 1, at a region of the container that is stronger due to its thicker wall.

At least one possible embodiment of the present application relates to a method for forming packaging units with each having a container sealed with a keg fitting and filled with a liquid product, and at least one possible embodiment of the present application relates to a device for forming packaging units each comprising a container sealed with a keg fitting and filled with a liquid product.

At least one possible embodiment of the present application relates to a method for forming packaging units each comprising a container sealed with a keg fitting and filled with a liquid product.

One feature or aspect of an embodiment is believed at the time of the filing of this patent application to possibly reside broadly in a method for forming packaging units each comprising a container 1 sealed with a keg fitting 3 and filled with a liquid product, wherein said method comprising the following method steps: preparing the respective plastics material container 1, filling the container 1 with the liquid product, supplying and inserting the respective fitting 3 into a container opening 2.1, and producing a tight connection between the container 1 and the fitting 3.

Another feature or aspect of an embodiment is believed at the time of the filing of this patent application to possibly reside broadly in the method for forming packaging units, wherein the respective container 1 is supported at a container neck 2 and/or at a container flange 2.3 when the fitting 3 is inserted and connected.

Yet another feature or aspect of an embodiment is believed at the time of the filing of this patent application to possibly reside broadly in the method for forming packaging units, wherein the respective container 1 is realized as a disposable keg and/or the respective fitting 3 is realized as a disposable fitting 3.

Still another feature or aspect of an embodiment is believed at the time of the filing of this patent application to possibly reside broadly in the method for forming packaging units, wherein large-volume containers 1, for example those with a container volume of 10-20 l, are used as containers.

A further feature or aspect of an embodiment is believed at the time of the filing of this patent application to possibly reside broadly in the method for forming packaging units, wherein the preparing of the containers 1, the filling of the containers 1, the supplying and placing of the fittings 3 onto the containers 1 and the connecting of the fittings 3 to the containers 1 are carried out directly one after another in time in one system 6.

Another feature or aspect of an embodiment is believed at the time of the filing of this patent application to possibly reside broadly in the method for forming packaging units, wherein the preparing of the containers 1 is effected by blow molding said containers.

Yet another feature or aspect of an embodiment is believed at the time of the filing of this patent application to possibly reside broadly in the method for forming packaging units, wherein the filling of each of the containers 1 is effected in a filling machine 15.

Still another feature or aspect of an embodiment is believed at the time of the filing of this patent application to possibly reside broadly in the method for forming packaging units, wherein the supplying and placing of the fittings 3 onto the containers 1 is also carried out within the filling machine 15.

A further feature or aspect of an embodiment is believed at the time of the filing of this patent application to possibly reside broadly in the method for forming packaging units, wherein the connecting of the fittings 3 to the containers 1 is also carried out within the filling machine 15.

Another feature or aspect of an embodiment is believed at the time of the filing of this patent application to possibly reside broadly in the method for forming packaging units, wherein the connecting of the fittings 3 to the containers 1 is carried out in a station 17, 20 or machine downstream of the filling machine.

Yet another feature or aspect of an embodiment is believed at the time of the filing of this patent application to possibly reside broadly in the method for forming packaging units, wherein the supplying and placing of the fittings 3 onto the containers 1 and the connecting of the fittings 3 to the containers 1 are carried out in a station 17, 20 or machine downstream of the filling machine.

Still another feature or aspect of an embodiment is believed at the time of the filing of this patent application to possibly reside broadly in the method for forming packaging units, wherein the connecting between the containers 1 and the fittings 3 is effected by screw-connecting the fitting to the containers 1.

A further feature or aspect of an embodiment is believed at the time of the filing of this patent application to possibly reside broadly in the method for forming packaging units, wherein the connecting of the fittings 3 to the containers 1 is carried out by pressing and/or locking the fittings 3 to the containers 1.

Another feature or aspect of an embodiment is believed at the time of the filing of this patent application to possibly reside broadly in the method for forming packaging units, wherein the use of fittings 3, which engage over the containers 1 in the manner of a cap exclusively on the outside surface of the container in the region of their container mouth.

Yet another feature or aspect of an embodiment is believed at the time of the filing of this patent application to possibly reside broadly in a device for forming packaging units each comprising a container 1 sealed with a keg fitting 3 and filled with a liquid product, said device having at least one fill position with filling device 16, against which the respective container 1 to be filled, being held at a container support 14 by its container mouth 2.1, is pressable for the fill process through relative movement between the filling device 16 and the container support 14, wherein at least one tool 21 at a position downstream of the fill position for producing the connection between the respective container 1 and the fitting 3 after the filling process.

Still another feature or aspect of an embodiment is believed at the time of the filing of this patent application to possibly reside broadly in the device for forming packaging units, wherein the fill position is formed by a filling machine 15.

A further feature or aspect of an embodiment is believed at the time of the filing of this patent application to possibly reside broadly in the device for forming packaging units, wherein the tool 21 for producing the connection between the respective container 1 and the fitting 3 is a component part of a station 20 or machine downstream of the filling machine for the permanent sealed connection between fitting 3 and container 1, in at least one possible embodiment a machine of the rotary type.

Another feature or aspect of an embodiment is believed at the time of the filing of this patent application to possibly reside broadly in the device for forming packaging units, wherein the at least one tool 19 is realized as a press-on tool or pressing tool 19 for creating a connection between the fitting 3 and the containers 1 by means of pressing and/or locking.

Yet another feature or aspect of an embodiment is believed at the time of the filing of this patent application to possibly reside broadly in the device for forming packaging units, wherein the at least one tool is realized for a screw-type connection between the containers 1 and the fittings 30.

Still another feature or aspect of an embodiment is believed at the time of the filing of this patent application to possibly reside broadly in the device for forming packaging units, wherein the filling machine being designed in a linear manner.

A further feature or aspect of an embodiment is believed at the time of the filing of this patent application to possibly reside broadly in the device for forming packaging units, wherein the filling machine being designed as a rotary type filling machine.

Another feature or aspect of an embodiment is believed at the time of the filing of this patent application to possibly reside broadly in the device for forming packaging units, wherein the device comprises means for supplying and placing the fittings 3 onto the containers 1 at the filling machine or at the station 17 or machine downstream of the filling machine 15.

One feature or aspect of an embodiment is believed at the time of the filing of this patent application to possibly reside broadly in a method of making a disposable plastic keg with a disposable dispensing tap fitting configured to be connected to a tap, which keg is configured to contain a beverage such as mineral water, table water, beer, or a similar beverage, said method comprising:

a) providing a plastic premolding configured to be blow molded into a keg;

b) preheating said plastic premolding;

c) stretch blow molding said preheated plastic premolding forming a disposable, one piece, plastic keg, said plastic keg comprising:

a disc shaped first wall enclosing a first end of said plastic keg;

a cylindrical side wall connected to said first wall of said plastic keg;

a second wall connected to said cylindrical side wall, opposite said first wall;

said second wall comprising a cylindrical neck axially extending from said second wall, said cylindrical neck comprising:

a mouth opening;

a first keg flange and a second keg flange disposed on an outer cylindrical surface of said neck, said first keg flange being disposed on said neck a greater axial distance away from said second wall than said second keg flange;

said first keg flange comprising an outer circumference and axial thickness sufficiently large to permit said first keg flange to sufficiently hold said disposable dispensing tap fitting and to seal said disposable dispensing tap fitting onto said neck; and said second keg flange being configured to support said disposable plastic keg, the beverage contained therein after filling of said disposable plastic keg, and withstanding a force applied to said disposable plastic keg upon pushing of said disposable dispensing tap fitting onto said neck of said disposable plastic keg and forcing said inwardly extending portion of said cylindrical connecting segment over said second keg flange;

d) providing said disposable dispensing tap fitting, said disposable dispensing tap fitting comprising:

a portion configured to dispense liquid beverage from said disposable plastic keg;

a cylindrical connecting segment connected to said dispensing portion of said disposable dispensing tap fitting, said cylindrical connecting segment being disposed and configured to axially extend from said dispensing portion;

a gasket surrounding an inner circumferential surface of said cylindrical connecting segment;

said gasket being configured for sealing said inner circumferential surface of said cylindrical connecting segment with an outer surface of said neck of said plastic keg;

said cylindrical connecting segment comprising an inwardly extending portion with an angled surface disposed and configured for expanding about said first keg flange and a surface adjacent said angled surface configured to grip said first keg flange;

e) supporting said disposable plastic keg about said second keg flange with an apparatus configured to support said disposable plastic keg;

said apparatus configured to support and dispose said disposable plastic keg being configured to support said disposable plastic keg, the beverage contained therein after filling of said disposable plastic keg, and withstanding a force applied to said disposable plastic keg upon pushing of said disposable dispensing tap fitting onto said neck of said disposable plastic keg and forcing said inwardly extending portion of said cylindrical connecting segment over said second keg flange;

f) filling said disposable plastic keg with a beverage by placing a filling device about said neck of said disposable plastic keg and flowing the liquid beverage substantially across the entire area of said mouth opening and maximizing production;

said filling device comprising a cylindrical portion with a recessed portion configured to receive and seal with an outer surface of a portion of said neck, proximate said mouth opening, of said disposable plastic keg, said filling device further comprising a dispensing opening centrally disposed with said recessed portion, said dispensing opening having a similar diameter but smaller than a diameter of said mouth opening and maximizing a filling rate of liquid beverage into said disposable keg through said mouth opening in said neck;

g) placing said cylindrical connecting segment of said disposable dispensing tap fitting onto said neck of said disposable plastic keg, after said step of filling said disposable plastic keg with a beverage;

h) pushing said disposable dispensing tap fitting onto said neck of said disposable plastic keg with a force and a speed sufficient to maximize production and expand said inwardly extending portion of said cylindrical connecting segment about said first keg flange but not being sufficiently great to damage said second keg flange or said apparatus configured to support and dispose said disposable plastic keg;

said step of pushing said disposable dispensing tap fitting onto said neck of said disposable plastic keg being performed with a closing tool, said closing tool comprising a hollow cylindrical portion disposed and configured to cooperate with a surface of said disposable tap fitting proximate said dispensing portion;

i) gripping said first keg flange with said surface of said inwardly extending portion configured to grip said first keg flange;

j) sealing said inner circumferential surface of said cylindrical connecting segment to said outer surface of said neck of said plastic keg with said gasket surrounding the inner circumferential surface of said cylindrical connecting segment;

k) releasing said disposable plastic keg from said apparatus configured to dispose said disposable plastic keg during filling; and l) maintaining a seal between said cylindrical connecting segment and said outer surface of said neck with said gasket to sufficiently contain the beverage in said disposable plastic keg.

Another feature or aspect of an embodiment is believed at the time of the filing of this patent application to possibly reside broadly in a method of making a disposable plastic keg with a disposable dispensing tap fitting configured to be connected to a tap wherein steps of supporting said disposable plastic keg about said second keg flange with an apparatus configured to support said disposable plastic keg, filling said disposable plastic keg with a beverage by placing a filling device about said neck of said disposable plastic keg and flowing the liquid beverage substantially across the entire area of said mouth opening and maximizing production, placing said cylindrical connecting segment of said disposable dispensing tap fitting onto said neck of said disposable plastic keg, after said step of filling said disposable plastic keg with a beverage, pushing said disposable dispensing tap fitting onto said neck of said disposable plastic keg, gripping said first keg flange with said surface of said inwardly extending portion configured to grip said first keg flange, and sealing said inner circumferential surface of said cylindrical connecting segment to said outer surface of said neck of said plastic keg, are performed sequentially in a filling machine.

Yet another feature or aspect of an embodiment is believed at the time of the filing of this patent application to possibly reside broadly in a method of making a disposable plastic keg with a disposable dispensing tap fitting configured to be connected to a tap, wherein at least of one said steps of supporting said disposable plastic keg about said second keg flange with an apparatus configured to support said disposable plastic keg, filling said disposable plastic keg with a beverage by placing a filling device about said neck of said disposable plastic keg and flowing the liquid beverage substantially across the entire area of said mouth opening and maximizing production, placing said cylindrical connecting segment of said disposable dispensing tap fitting onto said neck of said disposable plastic keg, after said step of filling said disposable plastic keg with a beverage, pushing said disposable dispensing tap fitting onto said neck of said disposable plastic keg, gripping said first keg flange with said surface of said inwardly extending portion configured to grip said first keg flange, and sealing said inner circumferential surface of said cylindrical connecting segment to said outer surface of said neck of said plastic keg, is performed in a separate station.

Still another feature or aspect of an embodiment is believed at the time of the filing of this patent application to possibly reside broadly in a method of making a disposable plastic keg with a disposable dispensing tap fitting configured to be connected to a tap, wherein said disposable dispensing tap fitting comprises a single use one way valve and said disposable plastic keg is configured to contain between about 10 liters and about 20 liters of liquid beverage.

A further feature or aspect of an embodiment is believed at the time of the filing of this patent application to possibly reside broadly in a method of filling and closing a disposable plastic keg with a disposable dispensing tap fitting, which keg is configured to contain a liquid beverage, said method comprising:

a) providing a plastic keg comprising a first wall enclosing a first end of said plastic keg, a side wall connected to said first wall, and a second wall connected to said side wall, opposite said first wall;

said second wall comprising a neck extending from said second wall, said neck comprising:

a mouth opening;

a first keg flange disposed on an outer surface of said neck, said first keg flange being configured to support said disposable plastic keg, the beverage contained therein after filling of said disposable plastic keg, and withstanding a force applied to said disposable plastic keg upon connecting said disposable dispensing tap fitting to said neck of the beverage filled disposable plastic keg;

b) providing said disposable dispensing tap fitting, said disposable dispensing tap fitting comprising:

a portion configured to dispense liquid beverage from said disposable plastic keg;

a connecting segment connected to said dispensing portion of said disposable dispensing tap fitting configured to connect and seal with said neck of said disposable plastic keg, c) supporting said disposable plastic keg about said first keg flange with an apparatus configured to support said disposable plastic keg;

said apparatus configured to support said disposable plastic keg being configured to support said disposable plastic keg, the beverage contained therein after filling of said disposable plastic keg, and withstanding a force applied to said disposable plastic keg upon connecting said disposable dispensing tap fitting to said neck of said disposable plastic keg;

d) filling said disposable plastic keg with a beverage through said mouth opening in said neck by flowing the liquid beverage substantially across the entire area of said mouth opening and maximizing production;

e) connecting and sealing said disposable dispensing tap fitting to said disposable plastic keg by connecting said connecting segment of said disposable dispensing tap fitting onto said neck of said disposable plastic keg, after said step of filling said disposable plastic keg with a beverage;

said step of connecting and sealing said disposable dispensing tap fitting to said disposable plastic keg being performed with a force and a speed sufficient to maximize production but not being sufficiently great to damage said first keg flange or said apparatus configured to support said disposable plastic keg.

Another feature or aspect of an embodiment is believed at the time of the filing of this patent application to possibly reside broadly in a method of filling and closing a disposable plastic keg with a disposable dispensing tap fitting, wherein the steps of providing a plastic keg, supporting said disposable plastic keg about said keg flange with an apparatus configured to support said disposable plastic keg, filling said disposable plastic keg with a beverage through said mouth opening in said neck, and connecting and sealing said disposable dispensing tap fitting to said disposable plastic keg by connecting said connecting segment of said disposable dispensing tap fitting onto said neck of said disposable plastic keg are performed in chronological sequence essentially immediately after one another in a filling machine.

Yet another feature or aspect of an embodiment is believed at the time of the filing of this patent application to possibly reside broadly in a method of filling and closing a disposable plastic keg with a disposable dispensing tap fitting, wherein the steps of providing a plastic keg, providing said disposable dispensing tap fitting, supporting said disposable plastic keg about said keg flange with an apparatus configured to support said disposable plastic keg, filling said disposable plastic keg with a beverage through said mouth opening in said neck, and connecting and sealing said disposable dispensing tap fitting to said disposable plastic keg by connecting said connecting segment of said disposable dispensing tap fitting onto said neck of said disposable plastic keg are performed in chronological sequence essentially immediately after one another in a beverage filling plant.

Still another feature or aspect of an embodiment is believed at the time of the filing of this patent application to possibly reside broadly in a method of filling and closing a disposable plastic keg with a disposable dispensing tap fitting, wherein at least of one said steps of providing a plastic keg, providing said disposable dispensing tap fitting, supporting said disposable plastic keg about said keg flange with an apparatus configured to support said disposable plastic keg, filling said disposable plastic keg with a beverage through said mouth opening in said neck, and connecting and sealing said disposable dispensing tap fitting to said disposable plastic keg by connecting said connecting segment of said disposable dispensing tap fitting onto said neck of said disposable plastic keg, is performed in a separate station in said beverage filling plant.

A further feature or aspect of an embodiment is believed at the time of the filing of this patent application to possibly reside broadly in a method of filling and closing a disposable plastic keg with a disposable dispensing tap fitting, wherein said cylindrical neck of said disposable plastic keg further comprises a second keg flange disposed on an outer cylindrical surface of said neck, said second keg flange being disposed on said neck a greater axial distance away from said second wall than said first keg flange;

said connecting segment of said disposable tap fitting comprising an inwardly extending portion with an angled surface disposed and configured for expanding about said second keg flange and a surface adjacent said angled surface configured to grip said second keg flange;

said second keg flange comprising an outer perimeter and axial thickness sufficiently large to permit said second keg flange to sufficiently hold said disposable dispensing tap fitting by cooperating with said connecting segment of said disposable dispensing tap fitting and to seal said disposable dispensing tap fitting onto said neck;

said step of connecting and sealing said disposable dispensing tap fitting to said disposable plastic keg comprising:

1) pushing said disposable dispensing tap fitting onto said neck of said disposable plastic keg with a force and a speed sufficient to maximize production and expand said inwardly extending portion of said cylindrical connecting segment about said second keg flange but not being sufficiently great to damage said second keg flange or said apparatus configured to support and dispose said disposable plastic keg; and 2) gripping said second keg flange with said surface of said inwardly extending portion configured to grip said second keg flange.

Another feature or aspect of an embodiment is believed at the time of the filing of this patent application to possibly reside broadly in a method of filling and closing a disposable plastic keg with a disposable dispensing tap fitting, wherein said step of pushing said disposable dispensing tap fitting onto said neck of said disposable plastic keg being performed with a closing tool, said closing tool comprising a hollow cylindrical portion disposed and configured to cooperate with a surface of said disposable tap fitting proximate said dispensing portion.

Yet another feature or aspect of an embodiment is believed at the time of the filing of this patent application to possibly reside broadly in a method of filling and closing a disposable plastic keg with a disposable dispensing tap fitting, wherein said cylindrical neck of said disposable plastic keg further comprises a threaded portion disposed on an outer cylindrical surface of said neck, said threaded portion being disposed on said neck a greater axial distance away from said second wall than said first keg flange;

said connecting segment of said disposable tap fitting comprising a threaded portion on an inner cylindrical surface configured to cooperate with said threaded portion disposed on an outer cylindrical surface of said neck;

said step of connecting and sealing said disposable dispensing tap fitting to said disposable plastic keg comprising screwing said disposable tap fitting onto said neck of said disposable plastic container.

One feature or aspect of an embodiment is believed at the time of the filing of this patent application to possibly reside broadly in a method of filling and closing a disposable plastic keg with a disposable dispensing tap fitting, wherein said step of providing a plastic keg comprises the steps of:

1) providing a plastic premolding configured to be blow molded into a keg;

2) preheating said plastic premolding; and 3) stretch blow molding said preheated plastic premolding forming said plastic keg.

Another feature or aspect of an embodiment is believed at the time of the filing of this patent application to possibly reside broadly in a method of filling and closing a disposable plastic keg with a disposable dispensing tap fitting, wherein said connecting segment of said disposable tap fitting comprises a gasket surrounding an inner circumferential surface of said cylindrical connecting segment, said gasket being configured for sealing said inner circumferential surface of said cylindrical connecting segment with an outer surface of said neck of said plastic keg;

said step of connecting and sealing said disposable dispensing tap fitting to said disposable plastic keg comprising sealing said inner circumferential surface of said cylindrical connecting segment to said outer surface of said neck of said plastic keg with said gasket surrounding the inner circumferential surface of said cylindrical connecting segment.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action, dated Mar. 5, 2009, and the International Search Report, dated November 27, and/or cited elsewhere are hereby incorporated by reference as if set forth in their entirety herein as follows: WO 2007/064277 A1, having the following "System and method for distribution and dispensing of beverages", published on Jun. 7, 2007; 4,678,101 A, having the following title "Dispensing container closure", published on Jul. 7, 1987; WO 01/00502 A, having the following title "Flexible container made of film material and filling method for filling such a container with a fluid substance", published on Jan. 4, 2001; DE 199 28 325 A1, having the following English translation of the German title "Bottle filling plant for poly(ethylene terephthalate) bottles comprises blow molding device, bottle washing machine and filling machine, bottles being transferred to washing machine after molding by series of conveyors", published on Dec. 28, 2000; 4,690,299 A, having the following title "Bulk carbonated beverage container", published on Sep. 1, 1987; and WO 03/014003 A, having the following title "Apparatus for processing and filling kegs for beverages in general", published on Feb. 20, 2003.

The patents, patent applications, and patent publications listed above in the preceding paragraph are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 025 286.4, filed on May 30, 2007, having inventor Alois MONZEL, and DE-OS 10 2007 025 286.4 and DE-PS 10 2007 025 286.4, and International Application No. PCT/EP2008/004209, filed on May 28, 2008, having WIPO Publication No. WO2008/145343 and inventor Alois MONZEL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent applications, that is, PCT/EP2008/004209 and Federal Republic of Germany Patent Application No. 10 2007 025 286.4, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/004209 and Federal Republic of Germany Patent Application No. 10 2007 025 286.4 from which this patent application claims priority which do not have to do with the correction of the translation in this patent application are not to be included in this patent application in the incorporation by reference.

Any statements about admissions of prior art in the original foreign patent applications PCT/EP2008/004209 and Federal Republic of Germany Patent Application No. 10 2007 025 286.4 are not to be included in this patent application in the incorporation by reference, since the laws relating to prior art in non-U.S. Patent Offices and courts may be substantially different from the Patent Laws of the United States.

U.S. patent application Ser. No. 11/690,624, filed on Mar. 23, 2007, having inventor Volker TILL, and title "BEVERAGE BOTTLING OR CONTAINER FILLING PLANT HAVING A BEVERAGE BOTTLE OR CONTAINER HANDLING MACHINE AND A METHOD OF OPERATION THEREOF", and its corresponding Federal Republic of Germany Patent Application No. 10 2006 013 843.0-16, filed on Mar. 25, 2006, are hereby incorporated by reference as if set forth in their entirety herein.

U.S. patent application Ser. No. 12/209,407, filed on Sep. 12, 2008, having inventor Monzel, Alois and title "METHOD AND DEVICE FOR THE MANUFACTURE OF DISPOSABLE, ONE-WAY, SINGLE-USE BEVERAGE KEGS FOR USE IN HOME BARS", and its corresponding Federal Republic of Germany Patent Application No. 10 2006 026 279.4, filed on Jun. 2, 2006, are hereby incorporated by reference as if set forth in their entirety herein.

U.S. patent application Ser. No. 11/886,381, filed on Dec. 23, 2005, having inventor Rolf BAUMGARTE, and title "METHOD AND DEVICE FOR THE BLOW-MOLDING OF CONTAINERS", and its corresponding Federal Republic of Germany Patent Application No. 10 2005 011 805.4, filed on Mar. 15, 2005, are hereby incorporated by reference as if set forth in their entirety herein.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" U.S. Pat. No. 6,971,219 entitled "Beverage bottling plant for filling bottles with a liquid beverage filling material and a labelling station for labelling filled bottles and other containers;" U.S. Pat. No. 6,973,767, entitled "Beverage bottling plant and a conveyor arrangement for transporting packages;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

Some examples of bottling and container handling systems and components thereof which may possibly be utilized or adapted for use in at least one possible embodiment, may possibly be found in the following U.S. patent applications: Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/954,012, filed on Sep. 29, 2004, Ser. No. 10/952,706, Ser. No. 10/962,183, filed on Oct. 8, 2004, Ser. No. 10/967,016, filed on Oct. 15, 2004, Ser. No. 10/982,706, filed on Nov. 5, 2004, Ser. No. 10/982,694, Ser. No. 10/982,710, Ser. No. 10/984,677, filed on Nov. 9, 2004, Ser. No. 10/985,640, filed on Nov. 10, 2004, Ser. No. 11/004,663, filed on Dec. 3, 2004, Ser. No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363.

Some examples of bottling systems, which may be used or adapted for use in at least one possible embodiment of the present may be found in the following U.S. patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

Some examples of interface arrangements that may possibly be utilized or possibly adapted for use in at least one possible embodiment of the present application may possibly be found in the following U.S. Pat. No. 5,001,704 issued to Narup et al. on Mar. 19, 1991; U.S. Pat. No. 5,961,356 issued to Fekete on Oct. 5, 1999; U.S. Pat. No. 6,621,692 issued to Johnson et al. on Sep. 16, 2003; U.S. Pat. No. 6,661,961 issued to Allen et al. on Dec. 9, 2003; U.S. Pat. No. 6,687,166 issued to Takahashi et al. on Feb. 3, 2004; and U.S. Pat. No. 6,687,779 issued to Sturm et al. on Feb. 3, 2004.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of bottling systems which may possibly be utilized or adapted for use in at least one possible embodiment may possibly be found in the following U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

Some examples of bottle or container molding or manufacturing systems, and components thereof, which may possibly be utilized or adapted for use in at least one possible embodiment may possibly be found in the following U.S. Pat. No. 7,157,040, entitled "Helical blow molding preform and method of manufacturing;" U.S. Pat. No. 7,153,127, entitled "Method and apparatus for blow molding hollow plastic containers;" U.S. Pat. No. 7,147,456, entitled "Mold device having a combination of molds for stretch blow molding;" U.S. Pat. No. 7,131,830, entitled "Blow molding machine;" U.S. Pat. No. 7,129,317, entitled "Slow-crystallizing polyester resins;" U.S. Pat. No. 7,118,005, entitled "Individual bottle coolers;" U.S. Pat. No. 7,115,309, entitled "Synthetic resin preform to be biaxially stretched and blow molded into a bottle;" U.S. Pat. No. 7,114,945, entitled "Blow mold device;" U.S. Pat. No. 7,101,506, entitled "Takeout and transfer apparatus and method for a wheel blow molding machine;" U.S. Pat. No. 7,101,170, entitled "Take-out device for rotary blow molding machine;" U.S. Pat. No. 7,097,060, entitled "Container with non-everting handgrip;" U.S. Pat. No. 7,094,863, entitled "Polyester preforms useful for enhanced heat-set bottles;" U.S. Pat. No. 7,093,411, entitled "Method for storing thermoplastic preforms in a container;" U.S. Pat. No. 7,083,407, entitled "Preform holding jig for biaxial orientation blow molding;" U.S. Pat. No. 7,081,285, entitled "Polyethylene useful for blown films and blow molding;" U.S. Pat. No. 7,033,162, entitled "Injection blow molding device;" U.S. Pat. No. 7,001,172, entitled "Clamping device for injection blow or injection stretch blow molding machine;" U.S. Pat. No. 6,971,864, entitled "Device for producing plastic hollow bodies using an extrusion blow molding method;" U.S. Pat. No. 6,888,103, entitled "Preform preheater;" U.S. Pat. No. 6,851,944, entitled "Mold tool clamping device for blow mold machines;" U.S. Pat. No. 6,848,900, entitled "Apparatus for handling injection molded preforms;" U.S. Pat. No. 6,848,899, entitled "Injection stretch blow molding device with transfer station and pitch changing for blow molding;" U.S. Pat. No. 6,848,896, entitled "Height adjusting device for adjusting the height of a blow mandrel;" U.S. Pat. No. 6,843,646, entitled "Nickel blow mold and holder defining heat transfer passages therebetween;" U.S. Pat. No. 6,839,652, entitled "Method and device for predicting temperature profiles throughout the thickness of a polymer preform;" U.S. Pat. No. 6,820,396, entitled "Method for storing thermoplastic preforms in a container;" and U.S. Pat. No. 6,814,922, entitled "Method and device for production of a blown container."

Some examples of cooling arrangements that may possibly be utilized or possibly adapted for use in at least one possible embodiment of the present application may possibly be found in the following U.S. Pat. No. 5,331,884 issued to Ando on Jul. 26, 1994; U.S. Pat. No. 6,553,766 issued to Shimizu et al. on Apr. 29, 2003; U.S. Pat. No. 6,585,095 issued to Savoyard et al. on Jul. 1, 2003; U.S. Pat. No. 6,609,884 issued to Harvey on Aug. 26, 2003; U.S. Pat. No. 6,638,123 issued to Kinomoto on Oct. 28, 2003; and U.S. Pat. No. 6,698,496 issued to Takayama et al. on Mar. 2, 2004.

Some examples of heater arrangements that may possibly be utilized or possibly adapted for use in at least one possible embodiment of the present application may possibly be found in the following U.S. Pat. No. 6,404,421 issued to Meijler et al. on Jun. 11, 2002; U.S. Pat. No. 6,515,264 issued to Toya et al. on Feb. 4, 2003; U.S. Pat. No. 6,548,786 issued to Takizawa et al. on Apr. 15, 2003; U.S. Pat. No. 6,555,796 issued to Cusack on Apr. 29, 2003; U.S. Pat. No. 6,633,727 issued to Henrie et al. on Oct. 14, 2003; and U.S. Pat. No. 6,677,557 issued to Ito et al. on Jan. 13, 2004.

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

Some examples of temperature sensors or sensor systems that may be used or adapted for use in at least one possible embodiment of the present invention may be found in the following U.S. patents: U.S. Pat. No. 5,960,857, issued to inventors Oswalt et al. on Oct. 5, 1999; U.S. Pat. No. 5,942,980, issued to inventors Hoben et al. on Aug. 24, 1999; U.S. Pat. No. 5,881,952, issued to inventor MacIntyre on Mar. 16, 1999; U.S. Pat. No. 5,862,669, issued to inventors Davis et al. on Jan. 26, 1999; U.S. Pat. No. 5,459,890, issued to inventor Jarocki on Oct. 24, 1995; U.S. Pat. No. 5,367,602, issued to inventor Stewart on Nov. 22, 1994; U.S. Pat. No. 5,319,973, issued to inventors Crayton et al. on Jun. 14, 1994; U.S. Pat. No. 5,226,320, issued to inventors Dages et al. on Jul. 13, 1993; U.S. Pat. No. 5,078,123, issued to inventors Nagashima et al. on Jan. 7, 1992; and U.S. Pat. No. 5,068,030, issued to inventor Chen on Nov. 26, 1991.

Some examples of position sensors or position sensor systems that may be used or adapted for use in at least one possible embodiment of the present invention may be found in the following U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Container
2 Container neck
2.1 Container mouth
2.2, 2.3 Flange at the container neck
3 Fitting
4 Valve insert
5 Sealing ring
6 System
7 Blow molding machine
8 Rotor
9 Blow mold
10 Premolding
11 Supplying unit
12 Conveyor screw
13 Conveyor screw
14 Container support
15 Station for filling the containers 1

16 Filling device
17 Station for bringing the containers 1 and fittings 3 together
18 Centering or transferring element
19 Supplying unit
20 Station for the permanent or virtually permanent sealing connection between fitting and container
21 Pressing tool
22 Conveying section
A Direction of conveying or transport
BA Container axis

What is claimed is:

1. A method of providing liquid-filled kegs, said method comprising the steps of:

filling an open plastic keg body with a liquid product while holding said keg body by its neck;

applying a disposable keg fitting to said filled keg body while holding said keg body solely by its neck, which said keg fitting comprises a valve insert that projects into said keg body and into said liquid product, and which valve insert is configured to dispense said liquid product therethrough; and releasing said neck of said filled, closed keg.

2. The method according to claim 1, wherein said keg body is configured to hold a large volume of a liquid product of at least 10 liters.

3. The method according to claim 2, wherein said neck comprises an outwardly projecting flange, and said step of holding said keg body solely by its neck comprises holding said keg body solely by said flange.

4. The method according to claim 3, wherein the plastic that forms said keg body is thickest at said neck, such that said neck and said flange are sufficiently strong to support said keg body upon being filled and also during application of said keg fitting after filling.

5. The method according to claim 4, wherein said valve insert comprises: an elongated tube configured to extend a substantial distance into said keg body, and a one-way valve configured to be opened solely to permit dispensing of liquid product.

6. The method according to claim 5, wherein:

said method further comprises moving at least one of: said plastic keg body and a filling device of a filling machine, to bring said plastic keg body into alignment with said filling device;

said method further comprises forming said plastic keg body by blow molding said plastic keg body to have a volume between 10 liters and about 20 liters; and said step of applying a keg fitting to said filled keg body comprises placing a cover portion of said keg fitting into an airtight connection with said neck, and then screwing, locking, or snap-fitting said cover portion to said neck.

7. The method according to claim 6, wherein:

said step of placing a cover portion of said keg fitting into an airtight connection with said neck is performed after filling in one of: said filling machine, and a closing machine downstream of said filling machine; and said step of screwing, locking, or snap-fitting said cover portion to said neck is performed in one of: said filling machine and said closing machine.

8. The method according to claim 7, wherein said liquid product is beer, said keg is a beer keg, and said method comprises filling said beer keg with beer.

9. The method according to claim 1, wherein said neck comprises an outwardly projecting flange, and said step of holding said keg body solely by its neck comprises holding said keg body solely by said flange.

10. The method according to claim 1, wherein the plastic that forms said keg body is thickest at said neck, such that said neck and said flange are sufficiently strong to support said keg body upon being filled and also during application of said keg fitting after filling.

11. The method according to claim 1, wherein said valve insert comprises: an elongated tube configured to extend a substantial distance into said keg body, and a one-way valve configured to be opened solely to permit dispensing of liquid product.

12. The method according to claim 3, wherein said step of applying a keg fitting to said filled keg body comprises placing a cover portion of said keg fitting into an airtight connection with said neck, and then snap-fitting said cover portion to said neck by pressing and forcing a locking portion of said cover portion past a second outwardly-projecting flange of said neck, wherein the outer diameter of said second flange is greater than the inner diameter of said locking portion.

13. A manufacturing apparatus for performing the method according to claim 1 of providing liquid-filled kegs, said manufacturing apparatus comprising:

a support arrangement configured to hold solely a neck of a keg body;

a filling device configured to fill a keg body with a liquid product while the keg body is held by said support arrangement; and a fitting device configured to apply a keg fitting to a filled keg body while the filled keg body is held by said support arrangement, which keg fitting comprises a valve insert that projects into the keg body and into the liquid product, and which valve insert is configured to dispense liquid product therethrough.

14. The manufacturing apparatus according to claim 13, wherein said support arrangement is configured to support a keg body configured to hold a large volume of a liquid product of at least 10 liters.

15. The manufacturing apparatus according to claim 14, wherein said support arrangement is configured to hold solely an outwardly projecting flange of a neck of a keg body.

16. The manufacturing apparatus according to claim 15, wherein said fitting device is configured to insert an elongated tube of a valve insert a substantial distance into a keg body.

17. The manufacturing apparatus according to claim 16, wherein said fitting device is configured to press a keg fitting into an airtight snap-fit connection with a keg body.

18. The manufacturing apparatus according to claim 16, wherein said fitting device is configured to screw a keg fitting into an airtight screw connection with a keg body.

19. The manufacturing apparatus according to claim 16, wherein said manufacturing apparatus further comprises a filling machine, which filling machine comprises said filling device and said fitting device, such that both filling of a keg body and application of a keg fitting are performable in said filling machine.

20. The manufacturing apparatus according to claim 16, wherein said manufacturing apparatus further comprises a filling machine and a closing machine disposed downstream of said filling machine; and one of (A) and (B):

(A) said filling machine comprises said filling device, and said closing machine comprises said fitting device, such that filling of a keg body is performable in said filling machine, and application of a keg fitting is performable in said closing machine; and (B) said filling machine comprises said filling device and a placement device configured to place a cover portion of a keg fitting into an airtight connection with a neck of a keg body, such that filling of a keg body and then placement of a keg fitting is performable in said filling machine; and said closing machine comprises said fitting device, such that application of the placed keg fitting is performable in said closing machine.

* * * * *